US009985385B2

(12) United States Patent
Nagasaka et al.

(10) Patent No.: US 9,985,385 B2
(45) Date of Patent: May 29, 2018

(54) CONNECTOR HAVING A HOUSING WITH A LOCK ARM

(71) Applicant: YAZAKI CORPORATION, Tokyo (JP)

(72) Inventors: Naokazu Nagasaka, Shizuoka (JP); Dacheng Jin, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days. days.

(21) Appl. No.: 15/078,451

(22) Filed: Mar. 23, 2016

(65) Prior Publication Data

US 2016/0301158 A1 Oct. 13, 2016

(30) Foreign Application Priority Data

Apr. 10, 2015 (JP) ..... 2015-080947

(51) Int. Cl.
*H01R 13/627* (2006.01)
*H01R 13/50* (2006.01)
*H01R 13/422* (2006.01)

(52) U.S. Cl.
CPC ..... *H01R 13/6272* (2013.01); *H01R 13/4223* (2013.01); *H01R 13/50* (2013.01); *H01R 13/6271* (2013.01)

(58) Field of Classification Search
CPC ..... H01R 13/6271; H01R 13/6272
(Continued)

(56) References Cited

U.S. PATENT DOCUMENTS 5,743,760 A * 4/1998 Inaba ..... H01R 13/6272 439/489
6,592,404 B2 * 7/2003 Endo ..... H01R 13/641 439/357

(Continued)

FOREIGN PATENT DOCUMENTS

CN 1369938 A 9/2002
CN 1720645 A 1/2006

(Continued)

OTHER PUBLICATIONS

Japanese Office Action for the related Japanese Patent Application No. 2015-080947 dated Jul. 21, 2017.

(Continued)

*Primary Examiner* — Abdullah Riyami
*Assistant Examiner* — Justin Kratt
(74) *Attorney, Agent, or Firm* — Kenealy Vaidya LLP

(57) ABSTRACT

A connector, for being joined to a mating connector, includes a housing. The housing includes a housing main body and a lock arm with an engagement protrusion. The housing main body is formed with a terminal accommodation chamber configured to accommodate a terminal and extending along a joining direction in which the connector is joined to the mating connector. The lock arm extends from a front end side of the housing main body to a rear end side of the housing main body along the joining direction. The lock arm is connected integrally with the front end side of the housing main body. The housing main body is formed with a through hole which extends along the joining direction and is disposed at a connecting part of the housing main body where the lock arm is connected to the housing main body.

3 Claims, 6 Drawing Sheets

(58) Field of Classification Search
USPC ..... 439/357, 690
See application file for complete search history.

(56) References Cited

U.S. PATENT DOCUMENTS

| | | | | |
|---|---|---|---|---|
| 7,470,157 | B2 * | 12/2008 | Hiramatsu | H01R 13/4365 439/595 |
| 2002/0102878 | A1 | 8/2002 | Murakami | |
| 2006/0160433 | A1 | 7/2006 | Machida et al. | |
| 2008/0009201 | A1 | 1/2008 | Hiramatsu | |
| 2016/0079705 | A1 * | 3/2016 | Horiuchi | H01R 13/639 439/345 |

FOREIGN PATENT DOCUMENTS

| | | | | |
|---|---|---|---|---|
| JP | 2009-211932 | A | | 9/2009 |
| JP | 2009211932 | A | * | 9/2009 |
| JP | 2010-170967 | A | | 8/2010 |
| JP | 2010-277946 | A | | 12/2010 |
| JP | 2011-210739 | A | | 10/2011 |
| JP | 2013-214438 | A | | 10/2013 |
| JP | 2013214438 | A | * | 10/2013 |

OTHER PUBLICATIONS

Chinese Office Action for the related Chinese Patent Application No. 201610223479.4 dated Dec. 25, 2017.

* cited by examiner

CONNECTOR HAVING A HOUSING WITH A LOCK ARM

CROSS REFERENCE TO RELATED APPLICATIONS

This application is based on Japanese Patent Application (No. 2015-080947) filed on Apr. 10, 2015, the contents of which are incorporated herein by way of reference.

BACKGROUND

The present invention relates to a connector which is connected to a mating connector.

As a conventional connector, a connector having a housing made of a resin is known which has a hollow part passing through in a direction orthogonal to a joining direction to a mating connector formed in a rising part of a lock arm engaged with a housing of the connector of the mating of connection (for instance, see patent literature 1). In the connector, a position where a bending stress acts in the rising part of the lock arm is dispersed by the hollow part, so that the damage of the lock arm is suppressed which is caused by a concentration of the bending stress on a specific part of the rising part.

[Patent Literature 1] JP-A-2013-214438

SUMMARY

It is therefore to one advantageous aspect of the invention to provide a connector which can suppress a cost of equipment and a production cost and improve a durability of a lock arm at the same time.

According to one aspect of the invention, there is provided a connector as below-described (1) to (5).

(1) A connector, for being joined to a mating connector, comprising a housing made of a resin, wherein the housing includes:

a housing main body which is formed with a terminal accommodation chamber configured to accommodate a terminal and extending along a joining direction in which the connector is joined to the mating connector, a lock arm extending from a front end side of the housing main body to a rear end side of the housing main body along the joining direction; and an engagement protrusion formed in the lock arm, configured to be engaged with an engagement part provided in a housing of the mating connector so that the housing main body is fit to a fitting recessed part formed in the housing of the mating connector, wherein the lock arm is connected integrally with the front end side of the housing main body, and wherein the housing main body is formed with a through hole which extends along the joining direction and is disposed at a connecting part of the housing main body where the lock arm is connected to the housing main body.

(2) The terminal may include an electric connection part configured to be conducted to a tab part of a terminal of the mating connector when the tab part is pushed into the electric connection part, and the through hole may be formed from the front end side of the housing main body at least over a connection part accommodation range in which the electric connection part is accommodated in the terminal accommodation chamber.

(3) The housing main body may be formed with a plurality of holes extending along the joining direction, the holes may be arranged in a width direction of the housing orthogonal to the joining direction, and the through hole in the connecting part may be arranged together with the holes in the width direction.

(4) The housing main body may be formed with a plurality of terminal accommodating chambers configured to accommodate a plurality of terminals and extending along the joining direction, each of the terminals may include an electric connection part configured to be conducted to a tab part of a terminal of the mating connector when the tab part is pushed into the electric connection part, and the through hole and the holes may be formed from the front end side of the housing main body at least over connection part accommodation ranges in which the electric connection parts are respectively accommodated in the terminal accommodation chambers.

(5) The through hole may be formed between the terminal accommodating chamber and an upper surface of the housing main body above which the lock arm is provided.

DETAILED DESCRIPTION OF EXEMPLIFIED EMBODIMENTS

Figure 1:
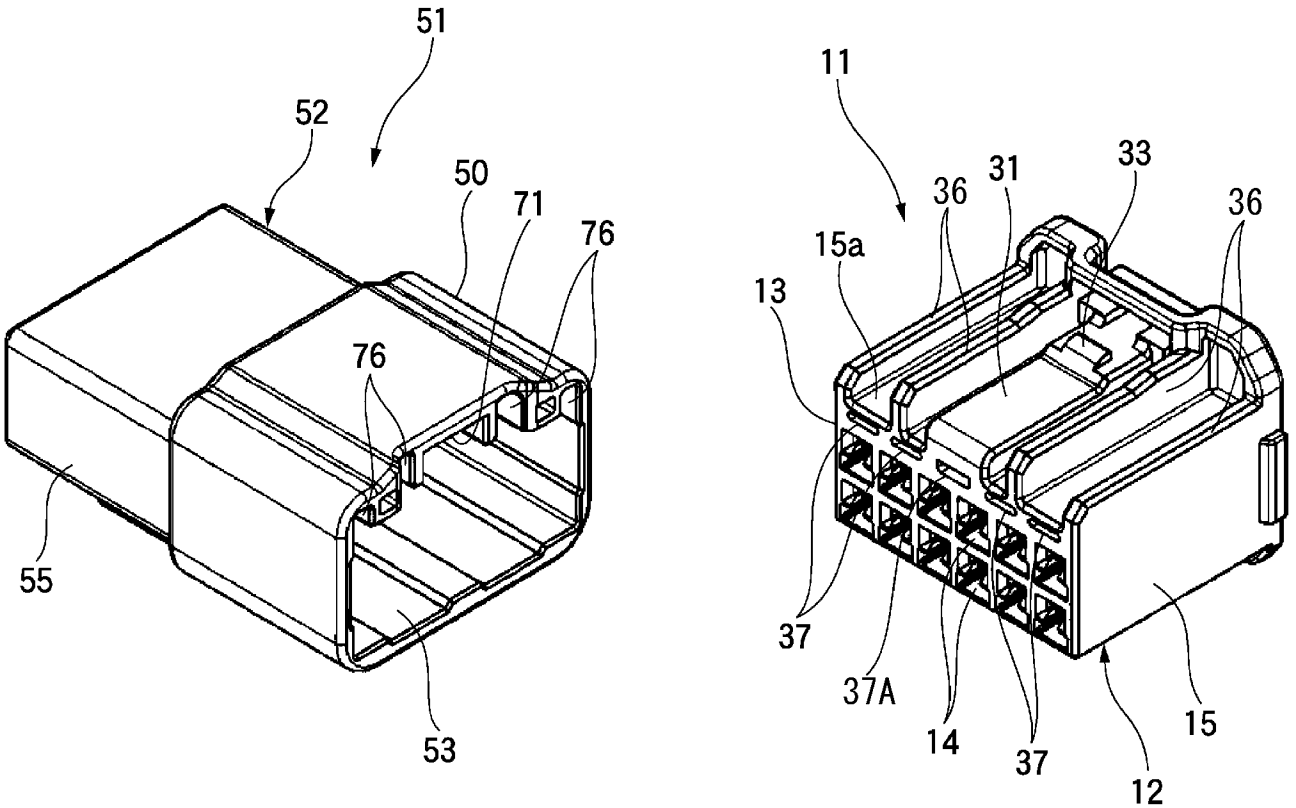
FIG. 1 is a perspective view of a connector according to a present exemplary embodiment and a mating connector.

In the housing of the conventional connector, terminal accommodation chambers are formed in which terminals electrically conducted and connected to terminals of the mating connector are accommodated. The terminal accommodation chambers are formed along the joining direction to the mating connector.

Accordingly, in the above-described conventional connector which has the terminal accommodation chambers extending along the joining direction to the mating connector and the hollow part intersecting at right angles to the joining direction to the mating connector, a molding die has a complicated structure in which a molding part of the terminal accommodation chambers and a molding part of the hollow part move in directions intersecting at right angles to each other. Thus, a cost of equipment and a production cost are increased.

The present invention is devised by considering the above-described circumstances, and it is an object of the present invention to provide a connector which can suppress a cost of equipment and a production cost and improve a durability of a lock arm at the same time.

Now, an example of an exemplary embodiment according to the present invention will be described below by referring to the drawings.

FIG. 1 is a perspective view of a connector according to a present exemplary embodiment and a mating connector.

As shown in FIG. 1, the connector 11 according to the present embodiment is joined to the mating connector 51.

The connector 11 is provided with a female housing (a housing) 12 made of a resin. The mating connector 51 is provided with a male housing (a housing) 52 made of a resin. The female housing 12 has an end side as a front side in a joining direction with the mating connector 51 set as a fitting part 13. In the male housing 52, a fitting recessed part 53 is formed in an end side as a front side in a joining direction with the connector 11. Then, the fitting part 13 of the female housing 12 is fitted to the fitting recessed part 53 of the male housing 52, so that the connector 11 is joined to the mating connector 51.

Figure 2:
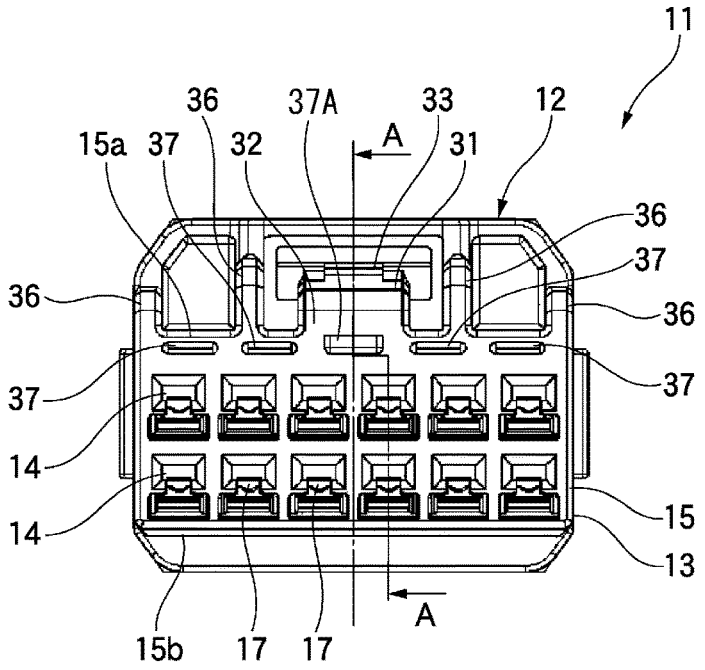
FIG. 2 is a front view of the connector according to the present exemplary embodiment.
Figure 3:
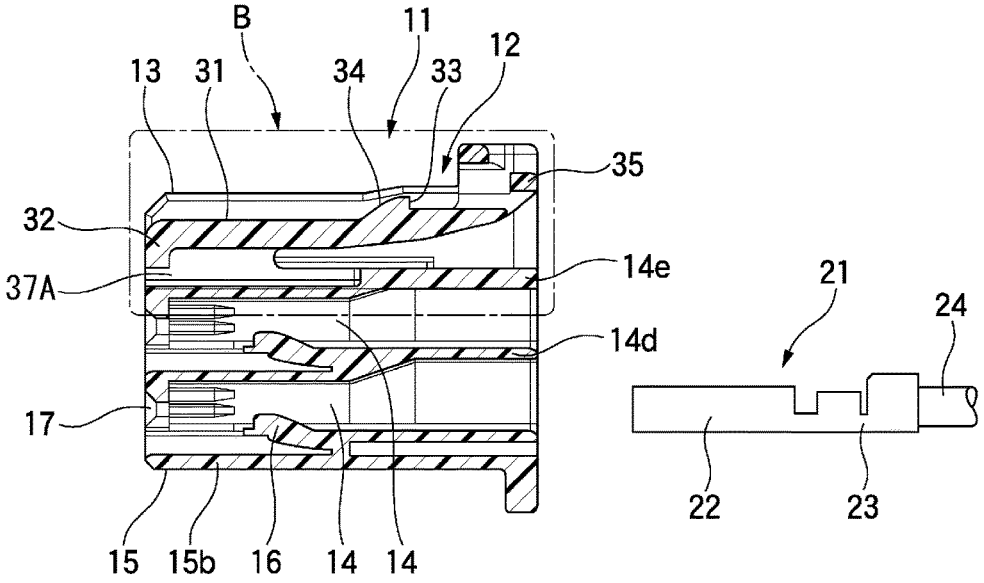
FIG. 3 is a sectional view taken along a line A-A in FIG. 2.
Figure 4:
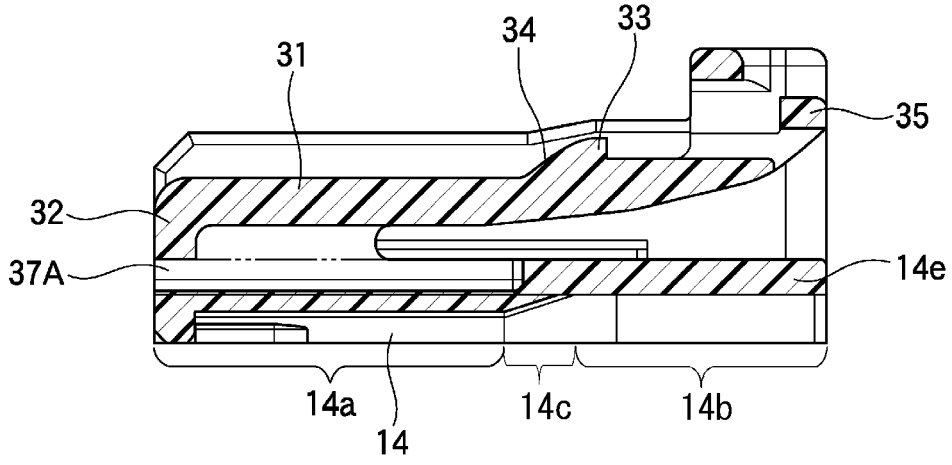
FIG. 4 is an enlarged view of a part B in FIG. 3.

FIG. 2 is a front view of the connector according to the present exemplary embodiment. FIG. 3 is a sectional view taken along a line A-A in FIG. 2. FIG. 4 is an enlarged view of a part B in FIG. 3.

As shown in FIG. 2 and FIG. 3, the female housing 12 of the connector 11 has a housing main body 15 in which a plurality of terminal accommodation chambers 14 are formed. The end side of the housing main body 15 is set as the fitting part 13. The terminal accommodation chambers 14 are extended along the joining direction with the mating connector 51. The terminal accommodation chambers 14 are arranged in a width direction of the housing main body 15 and an arrangement of the terminal accommodation chambers 14 includes two upper and lower steps. The width direction is orthogonal to the joining direction. The terminal accommodation chambers 14 respectively have lance parts 16 protruding from a lower side. Further, the terminal accommodation chambers 14 respectively have opening parts 17 in the end side of the housing main body 15.

In the terminal accommodation chambers 14, female terminals (terminals) 21 are accommodated from a rear end side as a rear side in the joining direction. The female terminal 21 is formed with an electrically conductive metal material, for instance, copper or copper alloy and has an electric connection part 22 and a crimping part 23. To the crimping part 23, an insulating electric wire 24 having a conductor coated with a sheath on its periphery is pressed and attached to be electrically conducted and connected. The female terminal 21 is inserted into the terminal accommodation chamber 14 from the rear end side of the housing main body 15 so that the electric connection part 22 is engaged with the lance part 16. Thus, the female terminal 21 is held in such a state as to be accommodated in the terminal accommodation chamber 14.

In the female housing 12, a lock arm 31 and a plurality of guide protrusions 36 are formed on an upper surface 15*a* side of the housing main body 15.

The lock arm 31 is provided on a central position in the width direction of the upper surface 15*a* of the housing main body 15. The lock arm 31 is connected to the end side in the joining direction of the housing main body 15. The lock arm 31 is extended from the connecting part 32 to the rear end side along the joining direction with the mating connector 51. In the lock arm 31, an engagement protrusion 33 is formed which protrudes upward in the vicinity of a rear end thereof in the joining direction with the mating connector 51. In the engagement protrusion 33, a guide surface 34 is formed which is formed with an inclined surface gradually inclined upward toward the rear end side of the lock arm 31. In the lock arm 31, a pressing part 35 is formed which protrudes upward in its rear end part. In the lock arm 31, since the pressing part 35 is pressed toward the housing main body 15, the lock arm 31 is elastically deformed toward the housing main body 15 side.

The guide protrusions 36 are provided at intervals in the width direction of the upper surface 15*a* of the housing main body 15. The guide protrusions 36 are extended along the joining direction with the mating connector 51.

The housing main body 15 of the female housing 12 has a plurality of holes 37. The holes 37 are formed between the terminal accommodation chambers 14 of the upper step side and the upper surface 15*a* in the housing main body 15. A through hole 37A is formed in a central position in the width direction of the housing main body 15. The through hole 37A is formed in the connecting part 32 to the lock arm 31 in the housing main body 15. The through hole 37A is formed between one of the terminal accommodation chambers 14 of the upper step side and the upper surface 15*a* in the housing main body 15.

As shown in FIG. 4, the through hole 37A is formed from the front end side of the housing main body 15 at least over connection part accommodation ranges 14*a* in which the electric connection parts 22 of the female terminals 21 are accommodated in the terminal accommodation chambers 14.

Figure 5:
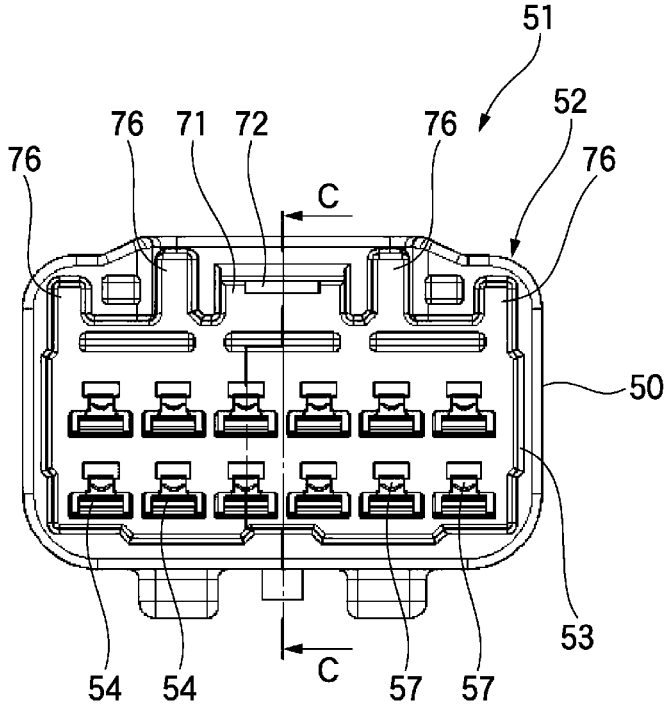
FIG. 5 is a front view of a mating connector.
Figure 6:
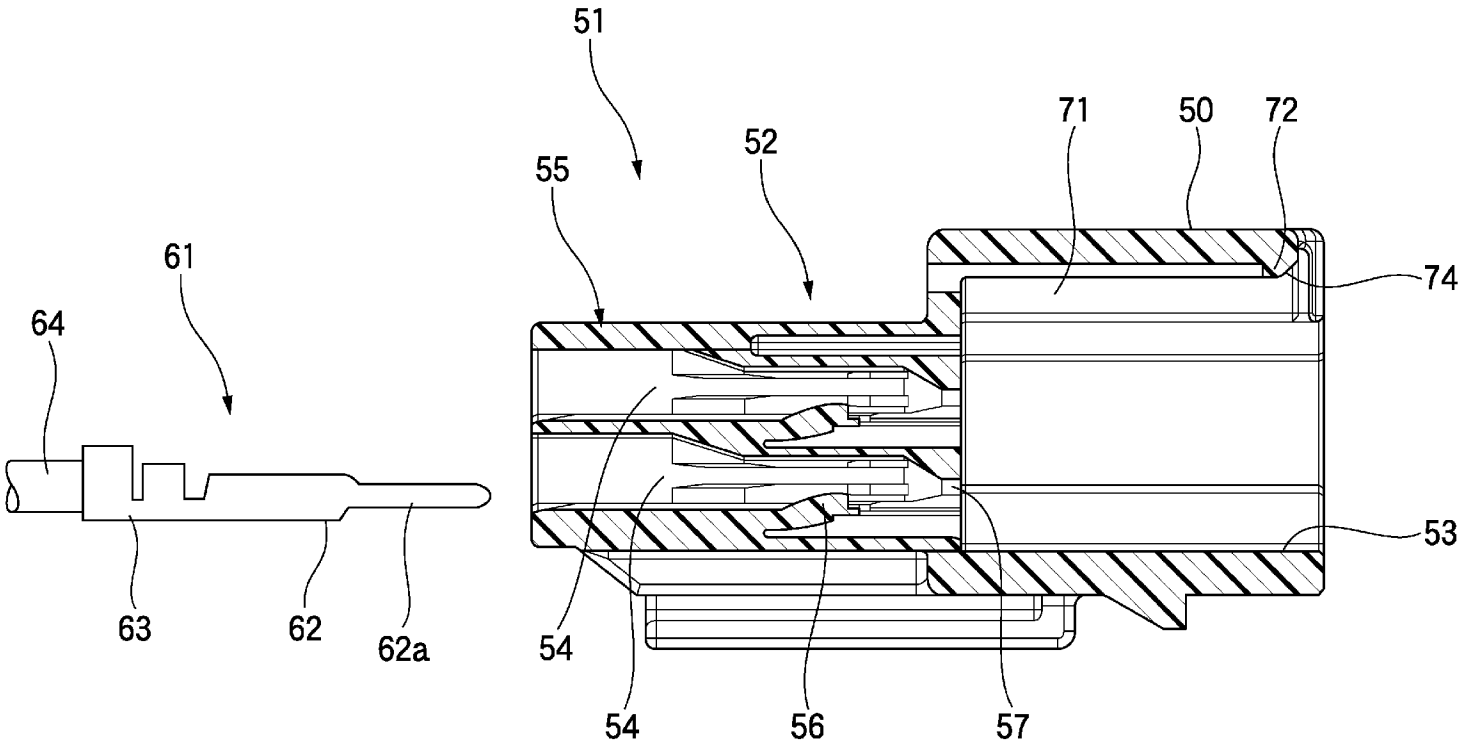
FIG. 6 is a sectional view taken along a line C-C in FIG. 5.

FIG. 5 is a front view of the mating connector. FIG. 6 is a sectional view taken along a line C-C in FIG. 5.

As shown in FIG. 5 and FIG. 6, the male housing 52 of the mating connector 51 has a housing main body 55 in which a plurality of terminal accommodation chambers 54 are formed. In an end side of the housing main body 55, a hood part 50 is formed. An inner side of the hood part 50 is set as the fitting recessed part 53. The terminal accommodation chambers 54 are formed along the joining direction to the connector 11. The terminal accommodation chambers 54 are arranged in a width direction of the housing main body 55 and an arrangement includes two upper and lower steps. The terminal accommodation chambers 54 respectively have lance parts 56 protruding from a lower side. Further, the terminal accommodation chambers 54 respectively have insert holes 57 in the end side of the housing main body 55.

In the terminal accommodation chambers 54, male terminals (terminals) 61 are accommodated from a rear end side as a rear side in the joining direction. The male terminal 61 is formed with an electrically conductive metal material, for instance, copper or copper alloy. and the male terminal 61 has an electric connection part 62 and a crimping part 63. The electric connection part 62 has a tab part 62*a* protruding forward. To the crimping part 63, an insulating electric wire 64 having a conductor coated with a sheath on its periphery is pressed and attached to be electrically conducted and connected. The male terminal 61 is inserted into the terminal accommodation chamber 54 from the rear end side of the housing main body 55 so that the electric connection part 62 is engaged with the lance part 56. Thus, the male terminal 61 is held in such a state as to be accommodated in the terminal accommodation chamber 54. Then, the male terminal 61 is accommodated in the terminal accommodation chamber 54, so that the tab part 62*a* of the electric connection part 62 is projected to the fitting recessed part 53 from the insert hole 57.

In the male housing 52, a lock groove part 71 and guide groove parts 76 are formed in an inner surface side of an upper part of the hood part 50. The lock groove part 71 is formed on a central position in a width direction of the hood part 50. In the lock groove part 71, an engagement pawl (an engagement part) 72 is formed in an end side of the hood part 50. In the engagement pawl 72, a guide surface 74 is formed which is formed with an inclined surface gradually inclined downward toward a rear end side of the hood part 50.

The guide groove parts 76 are provided at intervals in a width direction in the inner surface of the upper part of the hood part 50. The guide groove parts 76 are extended along the joining direction with the connector 11.

Now, a case that the connector 11 is joined to the mating connector 51 will be described below.

Figure 7:
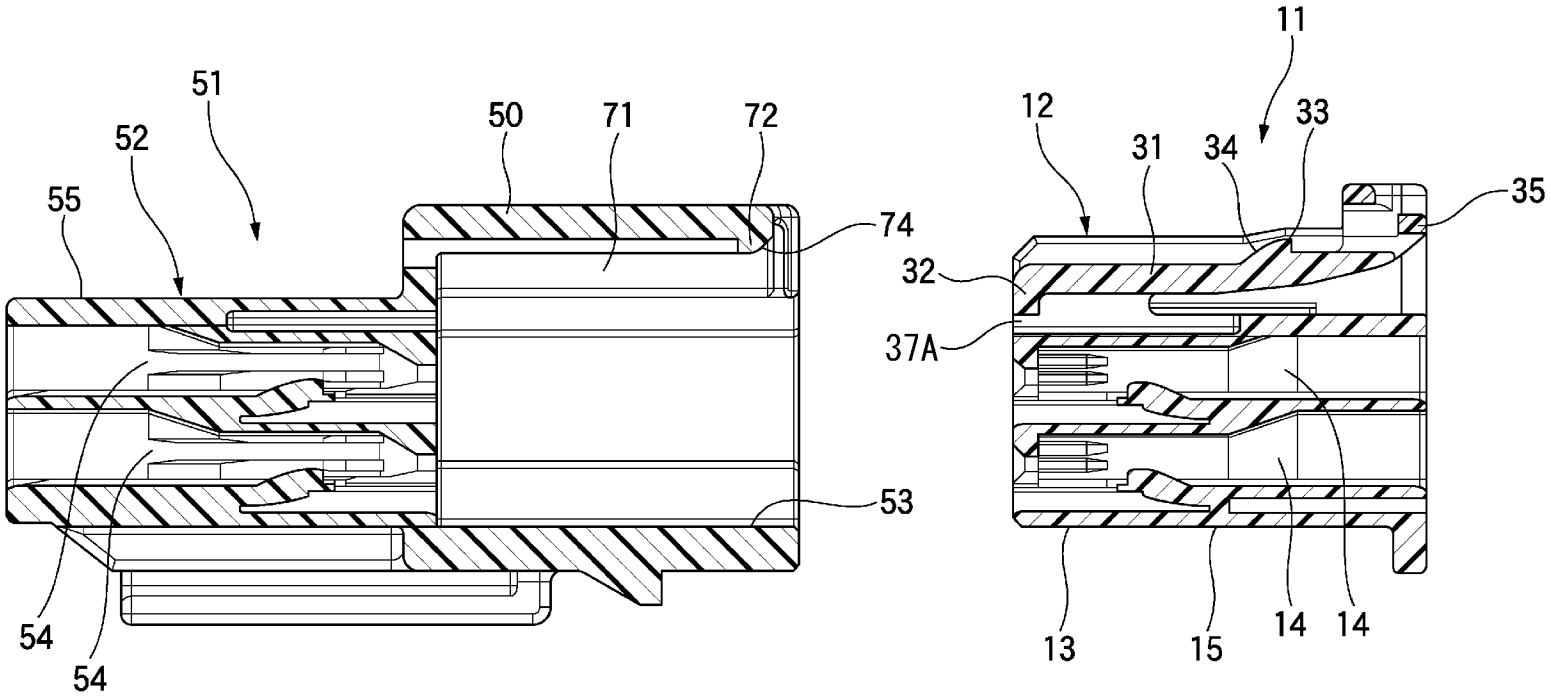
FIG. 7 is a longitudinally sectional view along a joining direction which explains a connection of the connector according to the present exemplary embodiment to the mating connector.
Figure 8:
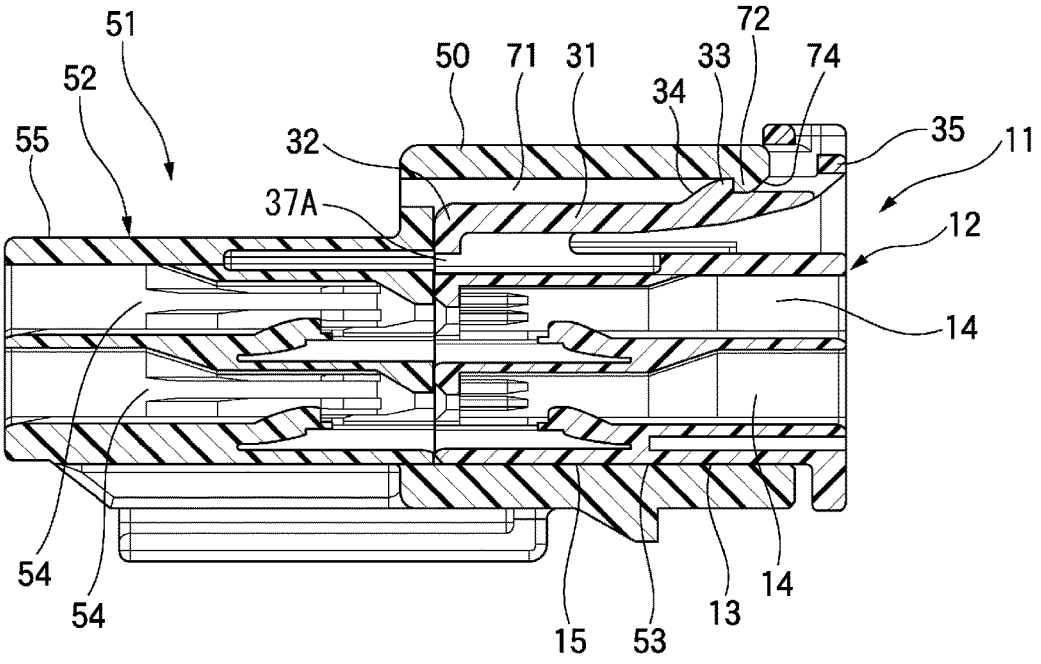
FIG. 8 is a longitudinally sectional view along the joining direction which shows a connected state of the connector according to the present exemplary embodiment and the mating connector.

FIG. 7 is a longitudinally sectional view along a joining direction which explains a joining of the connector according to the present exemplary embodiment to the mating connector. FIG. 8 is a longitudinally sectional view along the joining direction which shows a joined state of the connector according to the present exemplary embodiment and the mating connector.

As shown in FIG. 7, in order to connect the connector 11 to the mating connector 51, the end of the female housing 12 of the connector 11 is allowed to come close to the end of the male housing 52 of the mating connector 51. Then, the fitting part 13 of the housing main body 15 of the female housing 12 is inserted into the fitting recessed part 53 of the hood part 50 of the male housing 52. Thus, the guide protrusions 36 of the female housing 12 enter the guide groove parts 76 of the hood part 50 of the male housing 52 so that the connector 11 is guided in the joining direction to the mating connector 51. Further, the lock arm 31 of the female housing 12 enters the lock groove part 71 of the male housing 52.

When the fitting part 13 of the housing main body 15 of the female housing 12 is more inserted into the fitting recessed part 53 of the hood part 50 of the male housing 52, the guide surface 34 of the engagement protrusion 33 of the lock arm 31 abuts on the guide surface 74 of the engagement pawl 72 and they slide with each other. Thus, the lock arm 31 has its rear end side pressed to the housing main body 15 side and is elastically deformed so that an entire part thereof is bent.

Here, in the housing main body 15, the through hole 37A is formed in the connecting part 32 to the lock arm 31. Thus, in the lock arm 31, rigidity in the connecting part 32 is lowered. When the rear end side is pressed, a bending stress is not concentrated on a specific part and the entire part is uniformly bent. Thus, a damage of the lock arm 31 caused by the concentration of the bending stress on the specific part is suppressed.

As shown in FIG. 8, when the fitting part 13 of the housing main body 15 of the female housing 12 is more pushed into the fitting recessed part 53 of the hood part 50 of the male housing 52 so that the engagement protrusion 33 of the lock arm 31 goes over the engagement pawl 72 and reaches the housing main body 55 side of the male housing 52, the engagement protrusion 33 is disengaged from the engagement pawl 72 and the elastically deformed lock arm 31 is restored. Thus, the engagement protrusion 33 of the lock arm 31 is engaged with the engagement pawl 72, so that the male housing 52 is locked to the female housing 12 under a state that the male housing 52 is joined to the female housing 12. Under the joined state, the tab part 62*a* of the male terminal 61 is inserted to the electric connection part 22 of the female terminal 21 from the opening part 17 of the end side of the housing main body 15 of the female housing 12 and held, so that the female terminal 21 is electrically conducted and joined to the male terminal 61 to electrically conduct and connect the insulating electric wires 24 and 64 to each other.

In order to detach the connector 11 which is joined to the mating connector 51 in such a way as described above from the mating connector 51, the pressing part 35 in the rear end part of the lock arm 31 is pressed toward the housing main body 15 side. Then, the lock arm 31 is elastically deformed so as to bend the entire body of the lock arm 31. Thus, the locked state by the engagement of the engagement pawl 72 with the engagement protrusion 33 of the lock arm 31 is released.

At this time, since the through hole 37A is formed in the connecting part 32 to the lock arm 31, the bending stress is not concentrated on the specific part of the lock arm 31, so that the entire part of the lock arm 31 is bent. Thus, the damage of the lock arm 31 caused by the concentration of the bending stress on the specific part is suppressed.

Then, under a condition that the locked state of the lock arm 31 is released by pressing the pressing part 35, the connector 11 is detached from the mating connector 51. Thus, the fitting part 13 of the housing main body 15 of the female housing 12 is pulled out from the fitting recessed part 53 of the hood part 50 of the male housing 52. Thus, the tab part 62*a* of the male terminal 61 is pulled out from the electric connection part 22 of the female terminal 21, so that the electric conduction and joint of the female terminal 21 and the male terminal 61 is released.

As described above, in the connector 11 according to the present exemplary embodiment, since the through hole 37A is formed in the connecting part of the lock arm 31 in the housing main body 15, the concentration of the bending stress on the specific part is suppressed during the elastic deformation of the lock arm 31 when the engagement protrusion 33 of the lock arm 31 is engaged with or disengaged from the engagement pawl 72 and the damage of the lock arm 31 caused by the concentration of the bending stress on the specific part is suppressed, so that a durability of the lock arm 31 is improved.

Further, since the through hole 37A which suppresses the concentration of the bending stress on the specific part of the lock arm 31 is extended along the joining direction and extended in the same direction as that of the terminal accommodation chamber 14, a molding part of the through hole 37A and a molding part of the terminal accommodation chamber 14 in a molding die which forms the female housing 12 can be moved in the same direction. Thus, an increase of a cost of equipment and a production cost due to a complexity of a structure of the molding die can be suppressed and the durability of the lock arm 31 can be improved at the same time.

In a case that only the through hole 37A in the connecting part with the lock arm 31 is formed in the housing main body 15, an unevenness arises in thickness in the width direction of the housing main body 15. Thus, a distortion of the housing main body 15 arises due to shrinkage during a molding of the female housing 12, a molding accuracy of the terminal accommodation chambers 14 is deteriorated and an accuracy of an arrangement of the female terminals 21 accommodated in the terminal accommodation chambers 14 is also deteriorated.

However, in the connector 11 according to the present exemplary embodiment, since the plurality of holes 37 arranged in the width direction orthogonal to the joining direction in the housing main body 15 is formed in the connecting part of the lock arm 31 together with the through hole 37A, the unevenness in thickness in the width direction of the housing main body 15 can be more suppressed than the case that only the through hole 37A in the connecting part with the lock arm 31 is formed. Thus, a distortion due to shrinkage can be suppressed as much as possible during a molding of the housing main body 15 and the molding accuracy of the terminal accommodation chambers 14 can be improved. Accordingly, a joint accuracy of the female terminals 21 and the male terminals 61 can be improved during a joint to the mating connector 51. Further, since the plurality of holes 37 is provided, a quantity of resin to be used can be reduced so that the production cost may be more reduced.

Especially, the through hole 37A is formed from the front end side of the housing main body 15 at least over the connection part accommodation ranges 14*a* in which the electric connection parts 22 of the female terminals 21 are accommodated in the terminal accommodation chambers 14. Also, the holes 37 may be formed from the front end side of the housing main body 15 at least over the connection part accommodation ranges 14*a*. Accordingly, in the terminal accommodation chambers 14, since the electric connection parts 22 of the female terminals 21 are accommodated in the connection part accommodation ranges 14*a*, a molding accuracy in sections of the connection part accommodation ranges 14*a* which require a high accuracy can be assuredly increased.

As shown in FIG. 4, the terminal accommodation chamber 14 includes, in the rear end side of the connection part accommodation range 14*a*, a caulking piece accommodation range 14*b* as a range where a caulking piece of the crimping part 23 of the female terminal 21 which attaches the insulating electric wire 24 under pressure is accommodated and an inclined part forming range 14*c* which forms an inclined part to connect the connection part accommodation range 14*a* to the caulking piece accommodation range 14*b*. In order to increase an engagement and holding force between the female terminal 21 and the lance part 16, the connection part accommodation range 14*a* is formed to be lower than the caulking piece accommodation range 14*b* in a direction of height from a bottom wall 14*d* (see FIG. 3) which forms respectively the terminal accommodation chambers 14.

In the female housing 12 having the above-described terminal accommodation chamber 14, when the through hole 37 is formed up to the caulking piece accommodation range 14*b*, for an upper wall 14*e* of the terminal accommodation chamber 14 in the caulking piece accommodation range 14*b*, a prescribed thickness cannot be ensured. In a structure which cannot ensure the prescribed thickness, there is a fear that when the insulating electric wire 24 is pulled in a direction intersecting at right angles to a longitudinal direction of the terminal accommodation chamber 14, a load may be possibly applied to the upper wall 14*e* of the terminal accommodation chamber 14 to break the female housing 12.

In the present exemplary embodiment, since a depth of the through hole 37A and the holes 37 do not reach the caulking piece accommodation range 14*b* and is stopped in the inclined part forming range 14*c*, the female housing 12 can ensure the prescribed thickness for the upper wall 14*e* of the terminal accommodation chamber 14 in the caulking piece accommodation range 14*b*. Thus, even when the insulating electric wire 24 is pulled toward the direction intersecting at right angles to the longitudinal direction of the terminal accommodation chamber 14, the damage due to the load to the upper wall 14*e* of the terminal accommodation chamber 14 can be suppressed. The depth of the through hole 37 and the holes 37 may not reach the inclined part forming range 14*c*, but may be stopped in the connection part accommodation range 14*a*.

In the present invention, as long as the lock arm 31 which is locked to the male housing 52 of the mating connector 51 is provided, any connector may be used. For instance, either a waterproof connector having a waterproof structure and a non-waterproof connector having no waterproof structure may be used.

Further, in the above-described exemplary embodiment, the structure is described as an example that the engagement protrusion 33 of the lock arm 31 is engaged with the engagement pawl 72 of the male housing 52 of the mating connector 51. However, a structure may be used that an engagement hole is formed in the fitting recessed part 53 of the male housing 52 and the engagement protrusion 33 of the lock arm 31 is engaged with the engagement hole.

The present invention is not limited to the above-described exemplary embodiment and may be suitably modified and improved. In addition thereto, as long as the present invention can be achieved, materials, forms, dimensions, numbers, arranged positions or the like of component elements in the above-described exemplary embodiment may be arbitrarily used and are not limited.

Here, features of the above-described exemplary embodiment of the connector according to the present invention are respectively briefly stated and listed together in below-described (1) to (5).

(1) A connector 11, for being joined to a mating connector 51, comprising a housing 12 made of a resin, wherein the housing 12 includes:

a housing main body 15 which is formed with a terminal accommodation chamber 14 configured to accommodate a terminal 21 and extending along a joining direction in which the connector 11 is joined to the mating connector 51;

a lock arm 31 extending from a front end side of the housing main body 15 to a rear end side of the housing main body 15 along the joining direction; and an engagement protrusion 33 formed in the lock arm 31, configured to be engaged with an engagement part 72 provided in a housing 52 of the mating connector 51 so that the housing main body 15 is fit to a fitting recessed part 53 formed in the housing 52 of the mating connector 51, wherein the lock arm 31 is connected integrally with the front end side of the housing main body 15, and wherein the housing main body 15 is formed with a through hole 37A which extends along the joining direction and is disposed at a connecting part 32 of the housing main body 15 where the lock arm 31 is connected to the housing main body 15.

(2) The connector 11 according to the above (1), wherein the terminal 21 includes an electric connection part 22 configured to be conducted to a tab part 62*a* of a terminal 61 of the mating connector 51 when the tab part 62*a* is pushed into the electric connection part 22, and the through hole 37A is formed from the front end side of the housing main body 15 at least over a connection part accommodation range 14*a* in which the electric connection part 22 is accommodated in the terminal accommodation chamber 14.

(3) The connector 11 according to the above (1), wherein the housing main body 15 is formed with a plurality of holes 37 extending along the joining direction, the holes 37 are arranged in a width direction of the housing 12 orthogonal to the joining direction, and the through hole 37A in the connecting part 32 is arranged together with the holes 37 in the width direction.

(4) The connector 11 according to the above (3), wherein the housing main body 15 is formed with a plurality of terminal accommodating chambers 14 configured to accommodate a plurality of terminals 21 and extending along the joining direction, each of the terminals 21 includes an electric connection part 22 configured to be conducted to a tab part 62*a* of a terminal 61 of the mating connector 51 when the tab part 62*a* is pushed into the electric connection part 22, and the through hole 37A and the holes 37 are formed from the front end side of the housing main body 15 at least over connection part accommodation ranges 14*a* in which the electric connection parts 22 are respectively accommodated in the terminal accommodation chambers 14.

(5) The connector according to the above (1), wherein the through hole 37A is formed between the terminal accommodating chamber 14 and an upper surface 15*a* of the housing main body 15 above which the lock arm 31 is provided.

In the connector according to the present invention, since the through hole is formed in the connecting part of the lock arm in the housing main body, a concentration of a bending stress on a specific part is suppressed during an elastic deformation when the engagement protrusion of the lock arm is engaged with or disengaged from the engagement part provided in the housing of the mating connector and a damage of the lock arm caused by the concentration of the bending stress on the specific part is suppressed, so that a durability of the lock arm is improved.

Further, since the through hole which suppresses the concentration of the bending stress on the specific part of the lock arm is extended along the joining direction and extended in the same direction as that of the terminal accommodation chamber, a molding part of the through hole and a molding part of the terminal accommodation chamber in a molding die which forms the housing can be moved in the same direction. Thus, an increase of a cost of equipment and a production cost due to a complexity of a structure of the molding die can be suppressed and the durability of the lock arm can be improved at the same time.

In the connector according to the present invention, since the plurality of holes arranged in the width direction orthogonal to the joining direction in the housing main body is formed in the connecting part of the lock arm, unevenness in thickness in the width direction of the housing main body can be more suppressed than a case in which the through hole is formed only in the connecting part of the lock arm. Thus, a distortion due to shrinkage can be suppressed as much as possible during a molding of the housing main body and a molding accuracy of the terminal accommodation chambers can be improved. Accordingly, a joint accuracy of the terminals can be improved during a joint to the mating connector. Further, since the plurality of holes is provided, a quantity of resin to be used can be reduced so that the production cost may be more reduced.

In the connector according to the present invention, the through hole is formed from the front end side of the housing main body at least over the connection part accommodation ranges in which the electric connection parts of the terminals are accommodated in the terminal accommodation chambers. Accordingly, in the terminal accommodation chambers, since the electric connection parts of the terminals are accommodated in the connection part accommodation ranges, a molding accuracy in sections of the connection part accommodation ranges which require a high accuracy can be assuredly increased.

In view of the above, according to the present invention, the connector can be provided which can suppress the cost of equipment and the production cost and improve the durability of the lock arm at the same time.

What is claimed is:

1. A connector, for being joined to a mating connector, comprising a housing made of a resin, wherein the housing includes:

a housing main body which is formed with a terminal accommodation chamber configured to accommodate a terminal and extending along a joining direction in which the connector is joined to the mating connector; and a lock arm extending from a front end side of the housing main body to a rear end side of the housing main body along the joining direction, the lock arm being provided above an upper surface of the housing main body; and an engagement protrusion formed in the lock arm, configured to be engaged with an engagement part provided in a housing of the mating connector so that the housing main body is fit to a fitting recessed part formed in the housing of the mating connector, wherein the lock arm is connected integrally with the front end side of the housing main body, and wherein the housing main body is formed with a through hole which extends along the joining direction and through a connecting part of the housing main body where the lock arm is connected to the housing main body, the through hole extending from the front end side of the housing main body, cut through a front portion of the upper surface of the housing main body, and in communication with a space below the lock arm, wherein the housing main body is formed with a plurality of holes extending along the joining direction, the holes are arranged in a width direction of the housing orthogonal to the joining direction, and the through hole in the connecting part is arranged together with the holes in the width direction, wherein the housing main body is formed with a plurality of terminal accommodating chambers configured to accommodate a plurality of terminals and extending along the joining direction, each of the terminals includes an electric connection part configured to be conducted to a tab part of a terminal of the mating connector when the tab part is pushed into the electric connection part, and the through hole and the holes are formed from the front end side of the housing main body at least over connection part accommodation ranges in which the electric connection parts are respectively accommodated in the terminal accommodation chambers.

2. The connector according to claim 1, wherein the terminal includes an electric connection part configured to be conducted to a tab part of a terminal of the mating connector when the tab part is pushed into the electric connection part, and the through hole is formed from the front end side of the housing main body at least over a connection part accommodation range in which the electric connection part is accommodated in the terminal accommodation chamber.

3. The connector according to claim 1, wherein the through hole is formed between the terminal accommodating chamber and the upper surface of the housing main body above which the lock arm is provided.

* * * * *